US005651328A

United States Patent [19]

Elkington

[11] Patent Number: 5,651,328

[45] Date of Patent: Jul. 29, 1997

[54] OPEN BOAT HULL STRUCTURES

[76] Inventor: John Richard Elkington, 1117 Cypress Road, Sidney, British Columbia, Canada, V8L 5P4

[21] Appl. No.: 600,364

[22] Filed: Feb. 13, 1996

[51] Int. Cl.[6] ..... B63B 7/00

[52] U.S. Cl. ..... 114/345; 441/40

[58] Field of Search ..... 114/345, 352, 114/355, 357; 441/40

[56] References Cited

U.S. PATENT DOCUMENTS

| | | | |
|---|---|---|---|
| 4,724,792 | 2/1988 | Cochran | 114/345 |
| 4,928,619 | 5/1990 | Cochran | 114/345 |

FOREIGN PATENT DOCUMENTS

| | | | |
|---|---|---|---|
| 5319361 | 12/1993 | Japan | 114/345 |
| 2239429 | 7/1991 | United Kingdom | 114/345 |

*Primary Examiner*—Jesus D. Sotelo

*Attorney, Agent, or Firm*—Brian M. Long

[57] ABSTRACT

A glass fiber open boat hull structure has a lower hull component having a gel-coated outer surface facing outwardly of the hull structure and an upper edge extending along the hull structure, and an upper component extending along and joined to the upper edge of the lower hull component and projecting upwardly. The upper component has a gel-coated inner surface facing inwardly of the hull structure. A sole component mounted on the lower hull component has an upwardly facing gel-coated surface and a peripheral edge portion joined to the lower hull component. An elongate floatation chamber extends along the upper component in a recess formed in an outer surface thereof, and retainer members spaced apart along and connected to the floatation collar and other retainer members spaced apart along and connected to the upper component have apertures extending therethrough. A flexible securement line threaded through the apertures retains the floatation collar in the recess in the upper component.

16 Claims, 5 Drawing Sheets

OPEN BOAT HULL STRUCTURES

BACKGROUND OF THE INVENTION

1. Field of the Invention

The present invention relates to open boat hull structures and, in particular, to the structures of open boat hulls which are assembled from components formed of molded glass fiber material.

2. Description of the Related Art

In the construction of an open glass fiber boat hull of conventional construction, a layer of gel is firstly applied to the surface of a mold, and glass fiber is then applied on top of the gel coating. Usually, a foam core is formed in the glass fiber. When the glass fiber has cured, the component thus formed is removed from the mold. The gel coating then forms a smooth surface on one side of the component, while the opposite surface of the component remains rough. The component is then joined at the sheer to other components to form an open boat hull structure. These components usually comprise a hull component, forming the underside and the side of a hull, and a deck or liner component, which is mounted on the hull component in such way that a sealed hull void is formed between the hull component and the deck component. The hull and deck components are joined at the sheer or gunwale, which results in both of these components extending from the chine to the sheer, with consequential use of undesirably long construction times and the use of undesirably large amounts of material.

BRIEF SUMMARY OF THE INVENTION

According to the present invention, a boat hull structure comprises a lower hull component formed of molded glass fiber material and having a gel-coated surface facing outwardly of the hull structure and an upper edge extending along the hull structure, and an upper component formed of molded glass fiber material extending along the upper edge of the lower hall component and projecting upwardly therefrom. The upper component has a gel-coated inner surface facing inwardly of the hull structure and an outer surface facing outwardly of the hull structure, with an adhesive joint connecting the upper component to the lower hull component along the upper edge of the lower hull component. A sole component, also of molded fiber glass material, is mounted on the lower hull component and has an edge joined to the lower hull component below the upper component. Therefore, only one component, i.e. the upper component, is required to extend above the chine, resulting in substantial saving of production time and material.

In a preferred embodiment of the invention the outer surface of the upper component is covered and concealed by external covering in the form of a floatation chamber.

BRIEF DESCRIPTION OF THE DRAWINGS

Further features, advantages and objects of the present invention will be more readily apparent from the following description of a preferred embodiment thereof when taken in conjunction with the accompanying drawings, in which.

DESCRIPTION OF THE PREFERRED EMBODIMENTS

Figure 1:
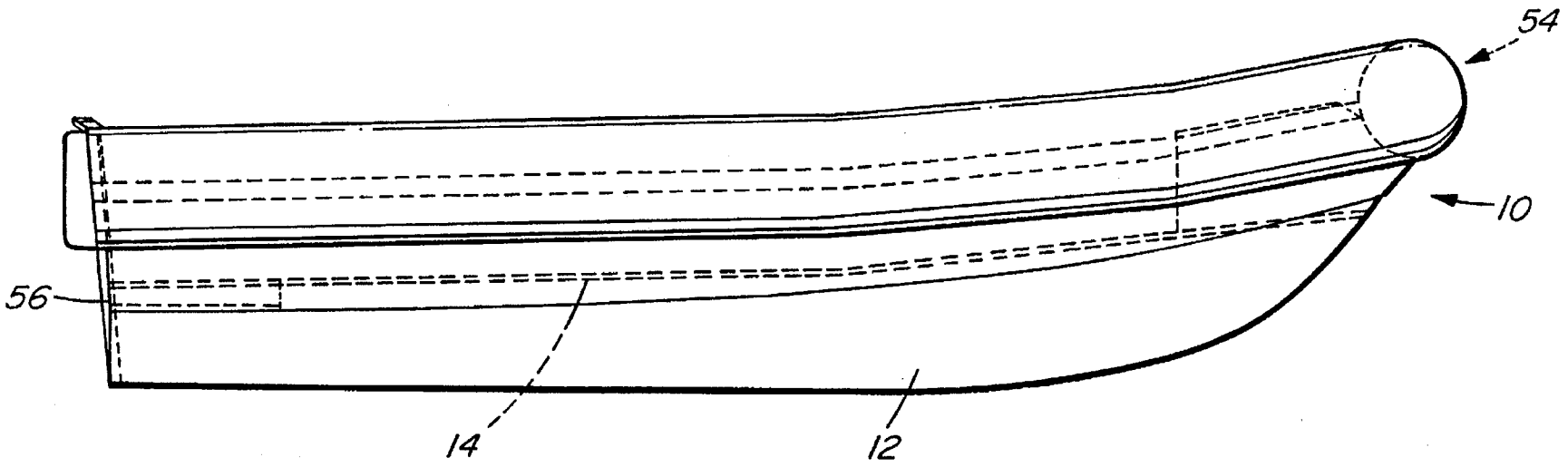
FIG. 1 shows a view in side elevation of a tender.
Figure 2:
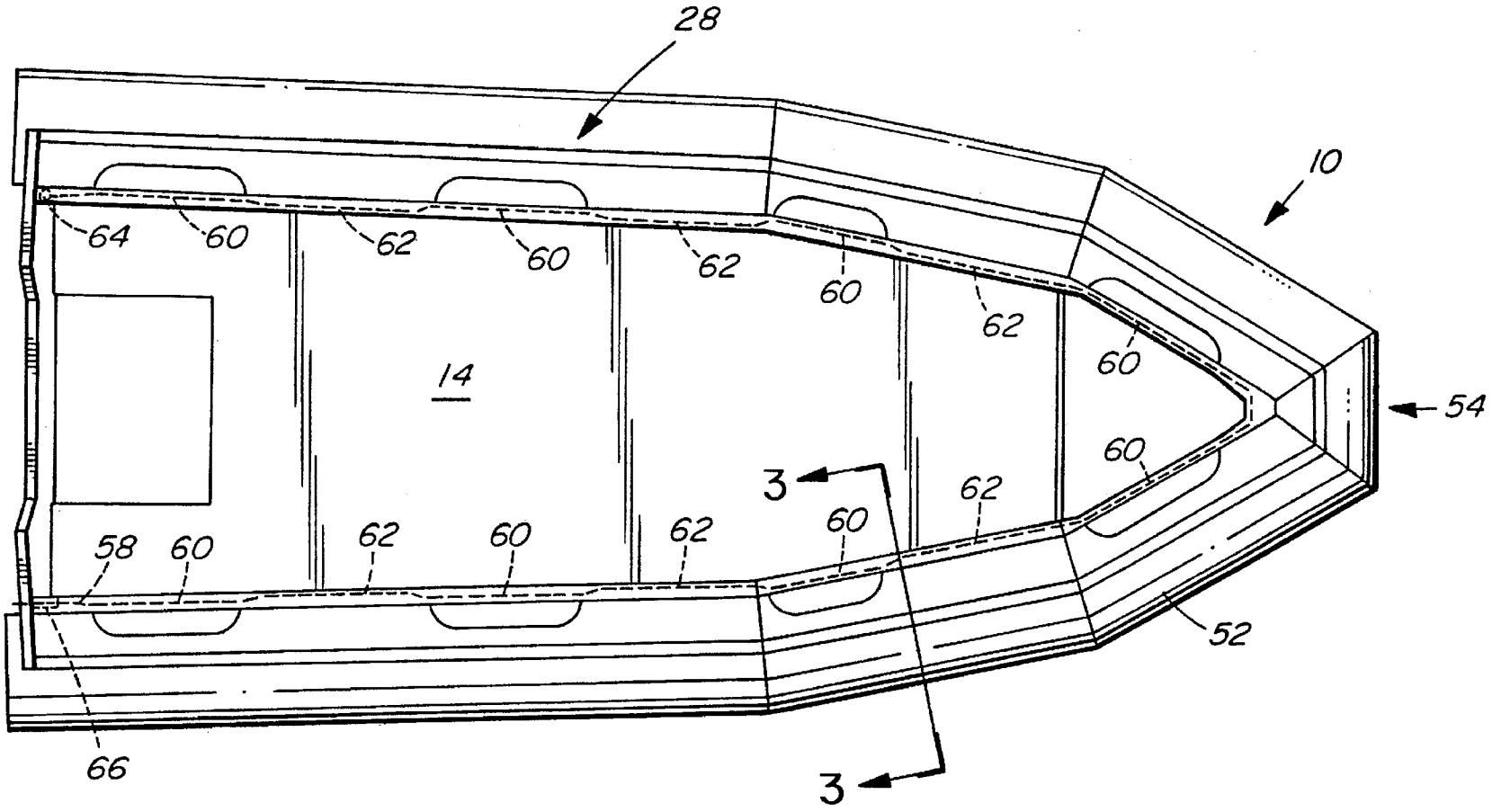
FIG. 2 shows a plan view of the tender of FIG. 1.

In FIGS. 1 and 2 of the accompanying drawings, there is illustrated a boat tender indicated generally by reference numeral 10, which has a hull structure comprising a lower hull component 12 formed of molded glass fiber material, and a sole component 14, which is secured on top of the lower hull component 12 so as to form a sealed hull void 16 (FIG. 3) between the sole component 14 and the lower hull component 12.

Figure 3:
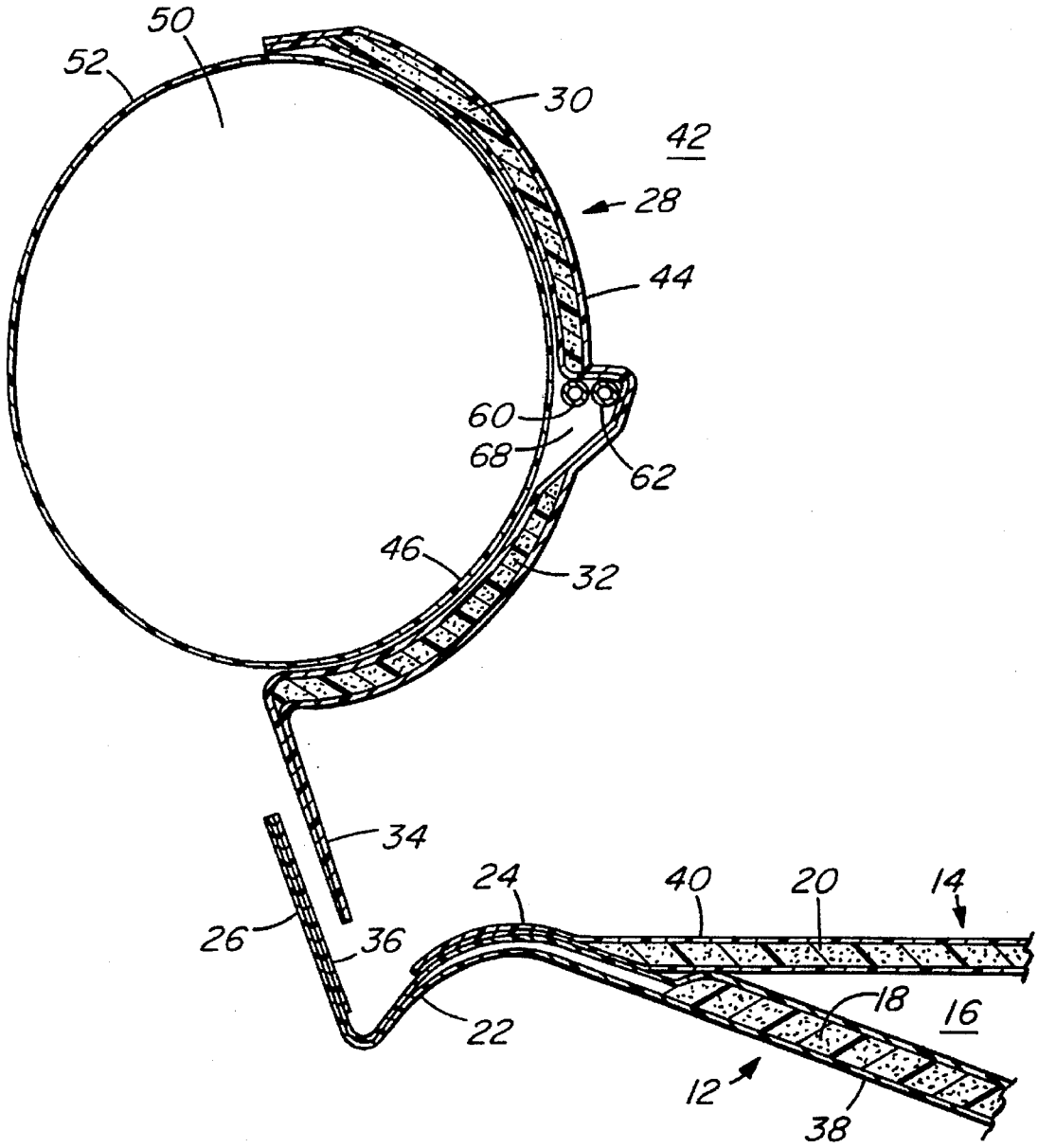
FIG. 3 shows a view taken in cross-section along the line 3—3 of FIG. 2.

As can be seen from FIG. 3, the lower hull component 12 and the sole component 14 have foam cores 18 and 20, respectively, and peripheral portions 22 and 24, which do not include any foam core. The peripheral portion 22 of the lower hull component 12 extends outwardly and upwardly, beyond the peripheral portion 24 of the sole component 14, so as to form an upwardly inclined attachment flange 26, which forms an upper edge of the lower hull component 12.

The hull structure also includes an upper component, indicated generally by reference numeral 28, which is formed with foam cores 30 and 32, and with a downwardly inclined attachment flange 34. In FIG. 3, the attachment flanges 26 and 34 are shown spaced-apart from one another, to clarify the illustration. However, when the boat hull structure is assembled, the attachment flanges 26 and 34 are bonded to one another by an adhesive 36, which may be a commercially available adhesive sold under the trade name "SIKAFLEX 292", so that a secure joint is formed between the lower hull component 12 and the upper component 28 near the chine.

The lower hull component 12 is formed with a gel-coated surface 38 facing outwardly of the hull structure, and the sole component 14 is formed with a gel-coated surface 40 facing upwardly, i.e. into the interior of a space 42 within the hull structure which will be occupied by the users.

The upper component 28 is formed with a gel-coated surface 44 facing inwardly of the hull structure, i.e. facing inwardly towards the space 42, and an outer surface 46, which is not gel-coated.

The upper component 28 is also formed with a substantially semi-cylindrical concavity 50 which faces outwardly of the boat hull structure and which snugly receives a portion of a tubular floatation chamber 52, which forms part of a floatation collar indicated generally by reference numeral 54 in FIG. 1, in which the floatation collar 54 is shown in broken lines. As can be seen from FIG. 1, the floatation collar 54 extends around the bows and opposite sides of the tender 10 and projects slightly aft of a transom 56. The floatation collar 54, in the present embodiment of the invention, comprises a tube of pneumatically inflated NEOPRENE NYPALON or fabric impregnated with vinyl chloride. Alternatively, the collar 54 may be filled with close&cell polyurethane foam or other closed-cell foam.

The floatation collar 54 is secured in position relative to the upper component 28 by means of a flexible securing line, in the form of a rope 58, which is threaded through a plurality of first retainer members comprising tubes 60, which are spaced apart along and connected to the floatation collar 54, and through a plurality of second retainer members comprising tubes 62, which are spaced apart along and connected to the upper component 28. Each of the tubes 60 is secured to the floatation collar 54 by a patch 61 of the same material as the floatation collar 54, the patch 61 being secured to its tube 60 by a line of stitching and to the floatation collar 54 by an adhesive (not shown). Likewise, the tubes 62 are secured to the upper component by adhesive and a secondary bond 63 of fiber reinforced plastic. As can be seen from FIG. 5, the tubes 60 and 62, which are made of polyvinyl chloride, are located alternately and are arranged in succession, with ends of successive ones of the tubes 60 and 62 spaced apart from one another, when the rope 58 is tightened to draw the floatation collar 54 snugly into the concavity 50, into the position in which the floatation collar 54 is shown in FIG. 2. One end of the rope 58 is secured to a deadeye 64 mounted on the hull structure, and the opposite end of the rope 54 is releasably and adjustably retained in a tensioning clam cleat 66, which incorporates a deadeye and which is also mounted on the hull structure.

Referring again to FIG. 3, it will be seen that, within the concavity 50, the upper component 28 is also formed with a recess 68, which opens outwardly of the hull structure and which serves to receive the tubular members 60 and 62. It can also be seen from FIG. 3 that the tubes 60, which are spaced apart along the rope 58 relative to the tubes 62, are laterally offset from the tubes 62.

Figure 5:
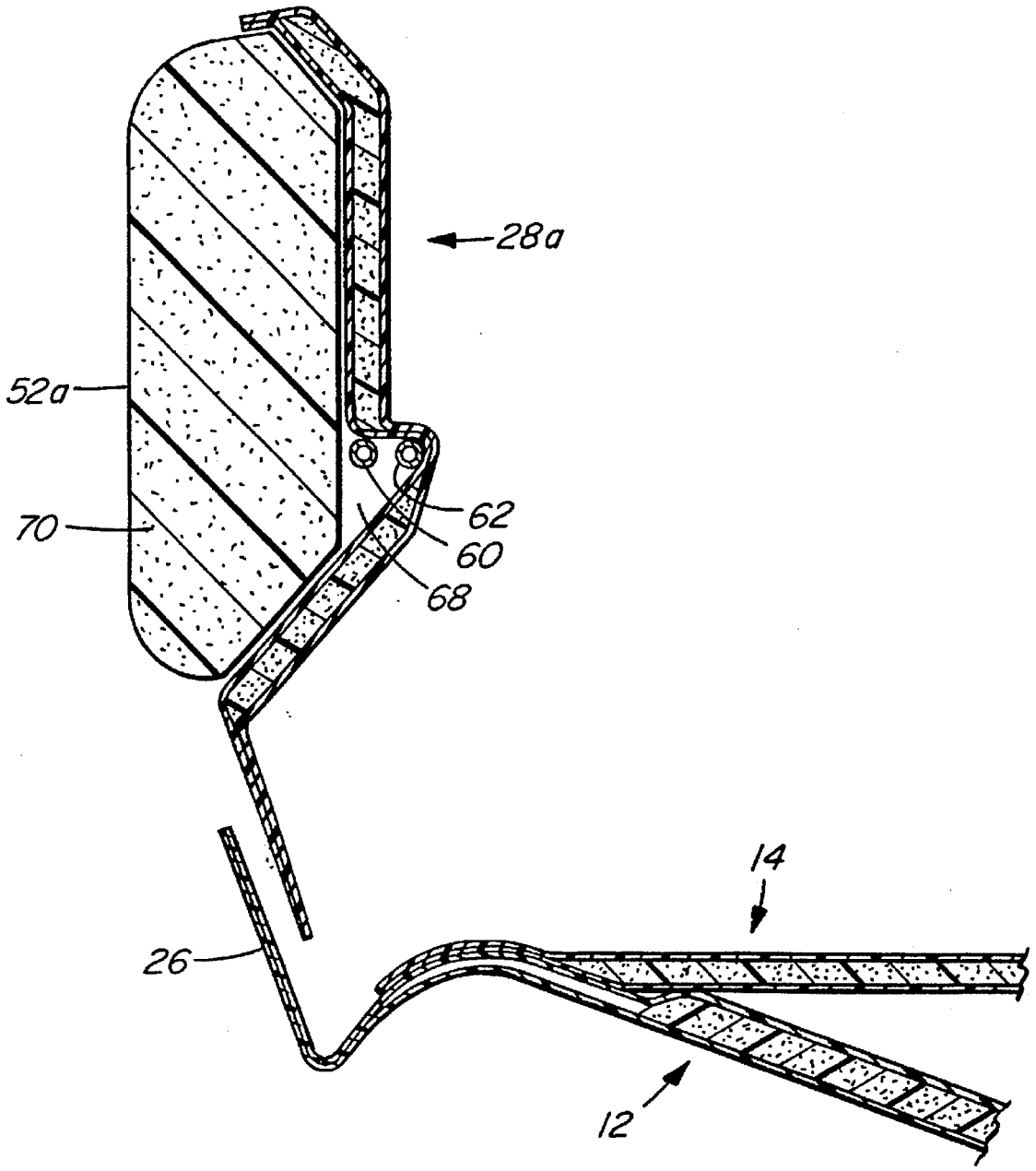
FIG. 5 shows a cross-sectional view corresponding to that of FIG. 3 but taken through a modification of the tender of FIGS. 1 and 2.

FIG. 5 shows parts of a modification of the components shown in FIG. 3. Parts shown in FIG. 5 which are identical to those of FIG. 3 are, for convenience, indicated by the same reference numerals. It will be seen, however, that the upper component 28 of FIG. 3 is replaced by a differently-shaped upper component **28*a* in FIG. 5, and also that the floatation chamber 52 of FIG. 3, which is of circular cross-section, is replaced in FIG. 5 by a floatation chamber 52*a* having a different shape and filled with a closed-cell foam 70**.

In both cases, however, the rough, non-gel-coated outer surface of the hull components 28 and **28*a* are covered and concealed by the floatation chambers 52 and 52*a***, respectively.

The use of the tubes 60 and 62 instead, of for example, retainer rings has the advantage that loads exerted by the rope 58 are distributed more evenly along the floatation collar 54 and the rope 58 is better protected against wear.

Figure 4:
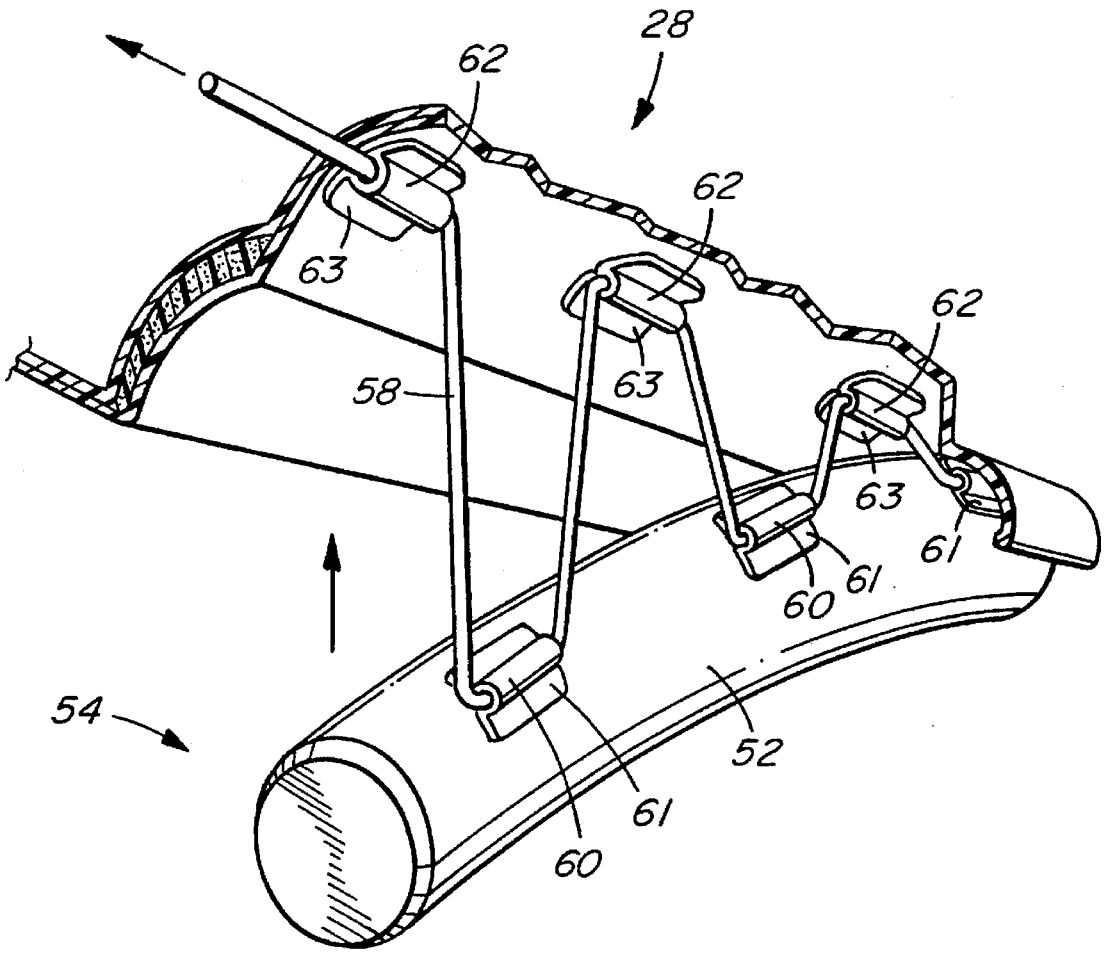
FIG. 4 shows a broken-away view, in perspective, of parts of the tender of FIG. 1.

It will be apparent from a comparison of FIGS. 4 and 5 that, by means of the present invention, a common lower hull component, e.g. the lower hull component 12, can be fitted with various components 28 and **28*a*** and others which are not shown, to provide a range of functionally and/or stylistically different boats with e.g. differing floatation collar shapes and compositions.

As will be apparent to those skilled in the art, various modifications may be made in the above described embodiments of the present invention within the scope and spirit of the appended claims.

I claim:

1. An open boat hull structure, comprising:

a lower hull component formed of molded glass fiber material, said lower hull component having a gel-coated outer surface facing outwardly of said hull structure and an upper edge extending along said hull structure;

an upper component formed of molded glass fiber material;

said upper component extending along and being joined to said upper edge of said lower hull component and projecting upwardly therefrom;

said upper component having a gel-coated inner surface facing inwardly of said hull structure and an outer surface facing outwardly of said hull structure;

a sole component of molded .glass fiber material mounted on said lower hull component;

said sole component having an upwardly facing gel-coated surface and a peripheral edge portion joined to said lower hull component; and an adhesive joint connecting said upper component to said lower hull component along said upper edge of said lower hull component.

2. An open boa hull structure as claimed in claim 1, further comprising an external covering extending over and concealing said outer surface of said upper component.

3. An open boat hull structure as claimed in claim 1, further comprising a floatation chamber extending over and concealing said outer side of said upper component.

4. An open boat hull structure, comprising:

a hull component of glass fiber material, said hull component having an outer surface facing outwardly of said hull structure;

an elongate floatation chamber extending along said hull component at said outer surface thereof;

a plurality of first retainer members spaced apart along and connected to said floatation collar;

a plurality of second retainer members spaced apart along and connected to said hull component, with said first and second retainer members being located alternately;

said retainer members each having an aperture extending therethrough;

a flexible securement line threaded through said apertures of said retainer members and retaining said floatation chamber in position relative to said hull component; and means for securing opposite ends of said flexible securement line to said hull structure.

5. An open boat hull structure as claimed in claim 4, wherein said means for securing include a cleat secured to said hull component and releasably and adjustably retaining said flexible elongate securement line.

6. An open boat hull structure as claimed in claim 4, wherein said retainer members comprise tubular members and said tubular members are arranged in succession with ends of successive ones of said tubular members spaced apart from one another.

7. An open boat hull structure as claimed in claim 4, wherein said hull component is formed with a concavity facing outwardly of said boat hull structure and snugly receiving a portion of said floatation chamber.

8. An open boat hull structure as claimed in claim 7, wherein said hull component has an inner surface facing inwardly of said boat hull structure and outer surface opposite from said inner surface and facing outwardly of said boat hull structure, said floatation chamber covers and conceals said outer surface of said hull component.

9. An open boat hull structure as claimed in claim 8, wherein said inner surface of said hull component is a gel-coated surface.

10. An open boa hull structure as claimed in claim 7, wherein said hull component is formed with an outwardly facing recess within said concavity for receiving said retainer members and said flexible securement line between said floatation collar and said hull component.

11. An open boat hull structure, comprising:

a lower hull component formed of molded glass fiber material, said lower hull component having a gel-coated outer surface facing outwardly of said hull structure;

an upper component formed of molded glass fiber material;

said upper component having a concavity facing outwardly of said hull structure;

a tubular floatation chamber partly received in said concavity;

said upper component extending along said upper edge of said lower hull component and projecting upwardly therefrom; p1 said upper component having a gel-coated inner surface facing inwardly of said hull structure;

a sole component of molded glass fiber material mounted on said lower hull component;

said sole component having an upwardly facing gel-coated surface and being joined to said lower hull component; and an adhesive joint connecting said upper component to said lower hull component and said sole component along said upper edge of said lower hull component.

12. An open boat hull structure, comprising:

a lower hull component formed of molded glass fiber material;

said lower hull component having a gel-coated outer surface facing outwardly of said hull structure and an upper edge extending along said hull structure;

an upper component formed of molded glass fiber material;

said upper component extending along and being joined to said upper edge of said lower hull component and projecting upwardly therefrom; p1 said upper component having a gel-coated inner surface facing inwardly of said hull structure;

a sole component of molded glass fiber material mounted on said lower hull component;

said sole component having an upwardly facing gel-coated surface and extending to said upper hull component;

said upper component having an outer surface opposite from said gel-coated inner surface and facing outwardly of said hull structure;

an elongate floatation chamber extending along said upper component at said outer surface thereof;

a plurality of first retainer members spaced apart along and connected to said floatation chamber;

a plurality of second retainer members spaced apart along and connected to said upper component, with said first and second retainer members being located alternately;

said retainer members each having an aperture extending therethrough;

a flexible securement line threaded through said retainer members and retaining said floatation chamber in position relative to said upper component; and means for securing opposite ends of said flexible securement line to said hull structure.

13. An open boat hull structure as claimed in claim 12, wherein said retainer members comprise tubular members and said tubular members are arranged in succession with ends of successive ones of said tubular members spaced apart from one another.

14. An open boat hull structure as claimed in claim 12, wherein said upper component is formed with a concavity facing outwardly of said boat hull structure and snugly receiving a portion of said floatation chamber.

15. An open boat hull structure as claimed in claim 12, wherein said floatation chamber covers and conceals said outer surface of said upper component.

16. An open boat hull structure as claimed in claim 12, wherein said hull component is formed with an outwardly facing recess within said concavity for receiving said retainer members and said flexible securement line between said floatation chamber and said upper component.

* * * * *